United States Patent [19]

Russell et al.

[11] 4,140,595

[45] Feb. 20, 1979

[54] USE OF MATERIALS IN MOLTEN SALT ELECTROLYSIS

[75] Inventors: Allen S. Russell, Pittsburgh, Pa.; Elmer H. Rogers, Jr., Palestine, Tex.

[73] Assignee: Aluminum Company of America, Pittsburgh, Pa.

[21] Appl. No.: 797,780

[22] Filed: May 17, 1977

[51] Int. Cl.[2] ..... C25C 3/00; C25C 3/06

[52] U.S. Cl. ..... 204/67; 204/64 R; 204/243 R

[58] Field of Search ..... 204/64 R, 67, 243 R

[56] References Cited

U.S. PATENT DOCUMENTS

| | | | |
|---|---|---|---|
| Re. 26,644 | 8/1969 | Forbes | 204/95 |
| 3,287,251 | 11/1966 | Horne et al. | 204/95 |
| 3,372,105 | 3/1968 | Johnson | 204/243 R |
| 3,773,643 | 11/1973 | Russell | 204/243 R |
| 3,983,275 | 9/1976 | Winter | 428/422 |

*Primary Examiner*—Howard S. Williams

*Attorney, Agent, or Firm*—Daniel A. Sullivan, Jr.

[57] ABSTRACT

A method including producing metal by electrolysis in a molten salt bath, in a bipolar cell, with the improvement involving electrically isolating the bath with a continuous, electrically insulating material in the portion of the cell containing the bath, the material being a plastic or rubber.

12 Claims, 2 Drawing Figures

USE OF MATERIALS IN MOLTEN SALT ELECTROLYSIS

BACKGROUND OF THE INVENTION

The present invention relates to a method of producing metal by electrolysis in a molten salt bath.

The present invention may be thought of as an improvement on the practice of using a glass barrier in the manner set forth in U.S. Pat. Nos. 3,773,643 and 3,779,699 of A. S. Russell and L. L. Knapp for "Furnace Structure", issued respectively on Nov. 20, and Dec. 18, 1973. These patents point out that it can be extremely difficult to contain the molten salt baths used for producing metal by electrolysis of aluminum chloride in bipolar cells. It has been discovered that, while the glass barrier will usually effectively contain molten salt baths, it is nevertheless possible occasionally for the baths to leak through the barrier, for instance around the edges of the individual glass sheets making up the glass barrier, or through cracks arising in the glass.

As indicated in these patents of Russell and Knapp, leakage of the molten salt bath into contact with the steel container of a cell can cause evolution of a substance such as chlorine at anodic locations. It is possible for this chlorine to quickly eat a hole in the steel. At cathodic locations, fingers of the metal being produced can grow from the steel inwards along the crack to lead to costly short circuiting of at least a portion of the bipolar cell. In this connection, it has been found in practice to be almost impossible to absolutely isolate the steel outer shell of a cell from being able to engage in the carrying of electrical current, once either the anode or cathode of the cell finds a way to the shell, for instance through molten electrolyte in a crack.

SUMMARY OF THE INVENTION

In view of the problems outlined in the background of the invention, it is an object of the present invention to provide a method of producing metal by electrolysis in a molten salt bath, in a bipolar cell, which method is improved by its ability to resist leakage of electrical current through molten salt away from the cell.

This as well as other objects which will become apparent in the discussion that follows are achieved, according to the present invention, by providing a method including producing metal by electrolysis in a molten salt bath, in a bipolar cell, wherein the improvement includes electrically isolating the bath with a continuous, electrically insulating material in the portion of the cell containing the bath, which material is a plastic or rubber.

Plastic or rubber containment of a bipolar cell in aqueous electrolytic systems has been practiced. Examples are the following U.S. Patents:

| Patent No. | Inventor | Issue Date |
|---|---|---|
| Re. 26,644 | Forbes | Aug. 19, 1969 |
| 3,287,251 | Horne et al. | Nov. 22, 1966 |

Apparently because of high temperatures involved in the electrolytically active portions of the cells, no one has ever thought of applying this technology of aqueous cells for molten salt cells. Even in the case of the cell (not a bipolar cell) in U.S. Pat. No. 3,372,105 issued Mar. 5, 1968, to A. F. Johnson for "Aluminum Reduction Cell and Insulation Material Therefor", where a plastic sheet is used, the actual electrical insulating during cell operation is done by a thin, dense layer of size-graded, electrically non-conductive, refractory mineral particles. The normal operational voltages that need be insulated against in a monopolar cell such as in U.S. Pat. No. 3,372,105 are relatively small as compared with those in the present invention concerned with bipolar cells where the normal operational voltage will in general be at least 10 volts.

An idea included in a narrower aspect of the present invention is to use cooling to bring the temperature in the walls of the cells to a level such that the particular plastic or rubber used should not be harmed by being subjected to a temperature higher than it is able to withstand. For example, the above-mentioned U.S. Pat. Nos. 3,773,643 and 3,779,699 mention water cooling of the cell. Further examples are the following U.S. patents:

| Patent No. | Inventor | Issue Date |
|---|---|---|
| 881,934 | von Kugelgen et al. | March 17, 1908 |
| 2,783,195 | Raynes et al. | Feb. 26, 1957 |

Care must be exercised, however, to make sure that the cooling actually gets to the plastic or rubber, because otherwise the material burns or carbonizes. This cooling of the plastic or rubber may be achieved, for example, by directly bonding the material, as a coating, to a cooled metal cell container.

The present idea of using plastic or rubber has been tried in cells of processes such as illustrated in U.S. Pat. No. 3,822,195 issued July 2, 1974, in the name of Dell et al. for "Metal Production" and it has been found that it accomplishes the objects nicely. In general, resistance measurements between (1) either of the bus bars connected to the anode and cathode and (2) a steel cell container coated with rubber or plastic according to the invention will read at least 2 ohms during process operation. Preferably, the resistance is at least 25 ohms and more preferably at least 40 ohms.

The present invention is particularly important in the case of a bipolar cell contained in a metal shell, for instance a steel shell, producing anode product, for instance chlorine, which eats through the metal on contacting it. Thus, if bath gets into contact with the metal shell, the fact that the cell is being operated in bipolar fashion means that a relatively large voltage is available for participation of the shell itself in an electrolysis. In practice, it has been found that, despite all measures to prevent it, the shell of a cell such as that in U.S. Pat. No. 3,822,195 generally assumes the voltage of the anode. In this case, almost the entire voltage across the cell may be brought into generating nascent chlorine on the steel shell. This nascent chlorine reacts essentially quantitatively with the steel, causing rapid perforation. Should perforation occur, coolant, such as water, from the cooling of the cell can enter into the molten bath where it reacts sometimes violently.

Even where it has been possible to completely isolate the shell, molten bath need only get into contact with the shell at two different locations and then up to almost the entire voltage across the cell can come into action again, producing chlorine at one location and metal at the other location.

It would be possible to make the walls of a cell thick enough such that the plastic or rubber could be placed far enough away from the electrolytically active region that the temperature existing at the location of the plastic or rubber could be below its maximum service temperature, without it being necessary to force the fall of temperature in the cell walls by, for instance, water cooling. However, there is a practical limit to this, i.e. the cost of building very thick walls on a cell must be balanced against the cost of using a technique such as water cooling.

DESCRIPTION OF THE PREFERRED EMBODIMENTS

Figure 1:
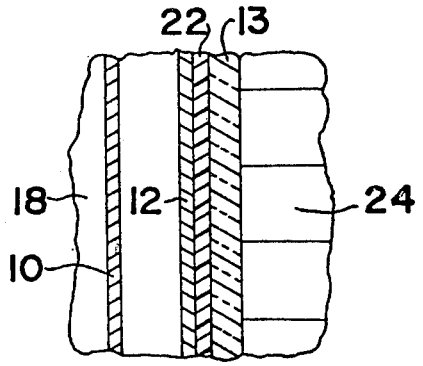
FIG. 1 is a sectional elevation of a portion of a cell for producing metal in accordance with the invention. Since this invention represents an improvement regarding just the walls of a cell such as that disclosed in U.S. Pat. No. 3,893,899, this FIG. 1 focusses just on the improvement, steel side 12 in this FIG. 1 corresponding to steel shell 1 in U.S. Pat. No. 3,893,899 and brick 24 here corresponding to brick 3 there.

A portion of a cell for electrolytically producing aluminum by the electrolysis of aluminum chloride dissolved in a molten salt bath utilizing the present invention is illustrated in the drawing. The cell structure includes an outer steel cooling jacket 10, which surrounds the steel sides 12 of the cell. A cooling fluid (coolant), for example water, flows through jacket 10 for withdrawing heat from the cell. A structural containment 18, for example of steel, encloses and supports the cell and the cooling jacket.

The bath-containing cell interior surfaces, i.e. those formed by sides 12 and a corresponding steel bottom, are lined, in accordance with the present invention, with a continuous, corrosion-resistant, electrically insulating lining 22 of plastic or rubber material. Good results have been obtained with a lining 22 composed of alternating layers of thermosetting epoxy-based paint and glass fiber cloth. Other plastic or rubber materials are possible. Thus, included as candidate plastic or rubber materials for application in the present invention are both the natural plastics such as asphalt and the synthetic plastics such as polytetrafluoroethylene, silicone resins, and, in general, epoxy resins. The rubber materials include both natural and synthetic rubbers also. Various fillers may be used, including fibrous reinforcements such as glass fibers. Also present may be, for example, antioxidants, heat stabilizers, and plasticizers. The particular plastic or rubber composition used will be selected taking into consideration, for example, the temperature to exist at its location, the manner of putting it in place, and the intended life of the cell.

Inwards of the lining 22 is interposed a glass barrier 13. For further information concerning this glass barrier, see the above-mentioned U.S. Pat. Nos. 3,773,643 and 3,779,699. The cell is also lined with refractory side wall brick 24, made of thermally insulating, electrically nonconductive, nitride material which is resistant to a molten aluminum chloride-containing halide bath and the decomposition products thereof (see U.S. Pat. No. 3,785,941 issued Jan. 15, 1974, in the name of S. C. Jacobs for "Refractory for Production of Aluminum by Electrolysis of Aluminum Chloride").

Figure 2:
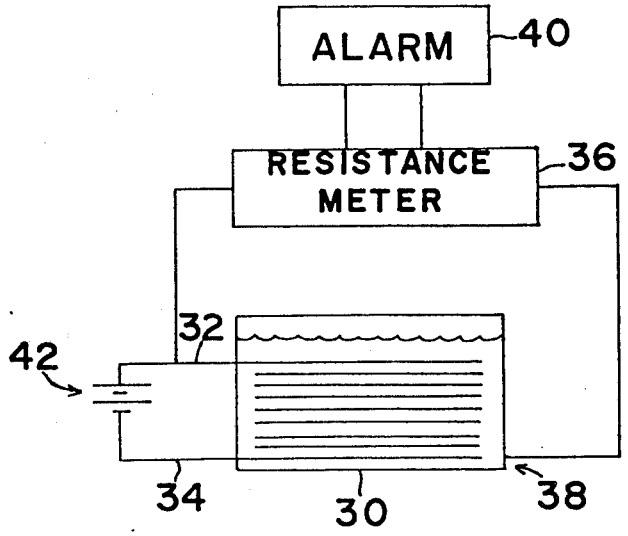
FIG. 2 is a schematic representation showing monitoring of the present invention.

Referring now to FIG. 2, there will be illustrated an example of how the monitoring of resistance can be accomplished. Bipolar cell 30 is provided with a sidewall and bottom construction as illustrated in FIG. 1 and has associated with it an anode bus 32 and a cathode bus 34. The desired resistance measurement of coating 22 (FIG. 1) may be achieved simply by connecting resistance meter 36 between any arbitrary point 38 on the steel shell 12 (FIG. 1) and, in the example illustrated here, anode bus 32. The resistances other than the desired resistance of coating 22 are in general sufficiently small that it is the resistance to flow of electrical current through the coating 22 that is being measured. However, with this connection of the resistance meter, it does not matter whether the glass barrier 13 (FIG. 1) or the brick 24 (FIG. 1) would be contributing major resistances to the flow of electrical current through the coating 22, the important thing being that a resistance is present. Furthermore, whether connection is made to the anode bus or the cathode bus makes only a negligible difference due to the conductivity of the molten salt. It can furthermore be advantageous to connect the other side of the resistance meter to jacket 10 (FIG. 1), since jacket 10 will in the usual case be in direct contact at the ends of the jacket with shell 12. A suitable resistance meter is that disclosed in the concurrently filed application of E. J. Seger et al. for "Method of Measuring the Integrity of an Electrolytic Cell Lining". The meter can be in operation continuously during the time that electrolysis is being carried out in cell 30, and an alarm 40 can be set to produce a warning signal and e.g. turn off electrolytic current supply 42 when the resistance measurement falls below e.g. 2 ohms.

Further illustrative of the present invention is the following example:

EXAMPLE

The steel shell formed by sides 12 and bottom (not shown) was sand blasted on its inner surfaces to remove mill scale, rust, oxide, etc. and then blown free of all foreign particles with dry air. The inner surfaces were then provided with four epoxy paint coats, and, interposed between each two adjoining epoxy paint coats, an epoxy paint coat with glass fiber cloth pressed in. This makes a total of three epoxy paint coats containing glass cloth plus the four plain epoxy paint coats equals seven coats directly bonded to the steel shell. The total thickness caused by these seven coats was one-eighth of an inch. The particular epoxy paint used was National Electric Coil Company ZA440 Thermopoxy Paint. Every coat of epoxy paint is applied to a wet thickness of 8 mils. The ZA440 Thermopoxy Paint is a two-part paint system requiring mixing of a base and a catalyst activator together. The mixing was done with an electric powered paint mixing paddle until both base and activator were thoroughly mixed, the mixing ratio for the two-part system being 1 part catalyst to 7 parts epoxy base, the parts being on a weight basis. Pot life of the mixed two-part system is 20 minutes, and only that amount of paint which could be mixed and applied within 20 minutes was applied at one time. The paint was applied with a paint roller and pan. The paint coat becomes tack-free in 4 to 8 hours. The complete cure of each paint coat requires 96 hours at room temperature. Curing time was accelerated by circulating hot water through jacket 10. Additional coats of paint were not applied until the preceding layer had completely cured. Following completion of the first plain coat of epoxy paint, a second coat of epoxy paint was applied to a wet thickness of 8 mils and into this second coat was pressed glass cloth. The glass cloth is pressed in while the paint is still wet. A roller is used to work out all wrinkles and air bubbles in the cloth. Curing is then effected. Following this comes a second coat of plain epoxy paint. This is cured and followed by the second coat of epoxy paint with glass cloth pressed into it, and so on. Abutting sections of glass cloth in any given coat were overlapped. The cell had holes in its sides for reception of ceramic tubes containing the anode and cathode leads. The same layered plastic coating was provided on walls of these holes. The gap between the holes and the ceramic tubes was finally packed tightly with ceramic fiber rope. See U.S. Pat. No. 3,745,106 issued July 10, 1973, in the name of S. C. Jacobs for "Fluid Sheathed Electrode Lead for Use in a Corrosive Environment". The remainder of the cell was constructed as a 12 compartment bipolar cell (i.e. an anode, a cathode and 11 bipolar electrodes) and then filled with an average molten salt bath of the following composition in weight percent:

NaCl: 51.0
LiCl: 40.0
$AlCl_3$: 6.5
$MgCl_2$: 2.5

The walls of cells working with this composition plus naturally occurring impurities have been found, upon autopsy, always to contain salt compositions which remain molten at temperatures below 120° C. and usually are at least partially molten at room temperature. Electrolysis to produce molten aluminum and chlorine was carried out with 31 volts across the cell and an average temperature of 715° C. During cell operation, resistance between bus and side 12 lay in the range between 40 and 100 ohms. It has been found that this variation is caused by things such as dust on the outside of the steel shell extending over the shell to the bus, so that holes in the plastic coating are not indicated by such variation. Only when the resistance falls perhaps below say 2 ohms need one really begin to get worried about holes in the coating.

It will be understood that the above description of the present invention is susceptible to various modifications, changes, and adaptations and the same are intended to be comprehended within the meaning and range of equivalents of the appended claims.

What is claimed is:

1. A method including the step of producing aluminum metal by electrolysis in a molten salt bath of temperature sufficient that the metal is obtained in the molten state, in a bipolar cell, the voltage across the cell being at least 10 volts, wherein the improvement comprises the step of electrically isolating the bath with a continuous layer of electrically insulating material in the portion of the cell containing the bath, said material being a plastic or rubber.

2. The method as claimed in claim 1 wherein said material is layers of epoxy paint and glass fiber cloth.

3. The method as claimed in claim 1 wherein a glass barrier is interposed between said bath and said material.

4. The method as claimed in claim 1 wherein said material is a coating on the interior of a metal shell.

5. The method as claimed in claim 4 wherein the resistance between a bus and the shell is at least 2 ohms.

6. The method as claimed in claim 4 wherein said shell is steel.

7. The method as claimed in claim 6 wherein chlorine is produced on anodic surfaces in the electrolysis.

8. The method as claimed in claim 7 wherein the electrolysis is of $AlCl_3$.

9. The method as claimed in claim 7, wherein the cell has an anode, a cathode and bipolar electrodes, and the shell has the voltage of the anode.

10. The method as claimed in claim 4 wherein said shell is cooled by communication with a coolant on the exterior surface thereof.

11. The method as claimed in claim 4 wherein at least portions of said bath remain molten at temperatures below 120° C.

12. The method as claimed in claim 11, wherein at least portions of said bath remain molten at room temperature.

* * * * *